US010403198B2

(12) United States Patent
Kim et al.

(10) Patent No.: US 10,403,198 B2
(45) Date of Patent: Sep. 3, 2019

(54) DISPLAY APPARATUS

(71) Applicant: Samsung Display Co., Ltd., Yongin-si (KR)

(72) Inventors: Taejin Kim, Bucheon-si (KR); Hae-kwan Seo, Hwaseong-si (KR); Ahyoung Son, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 8 days.

(21) Appl. No.: 15/607,859

(22) Filed: May 30, 2017

(65) Prior Publication Data

US 2017/0358258 A1 Dec. 14, 2017

(30) Foreign Application Priority Data

Jun. 8, 2016 (KR) ..... 10-2016-0071262

(51) Int. Cl.
*G09G 3/3225* (2016.01)

(52) U.S. Cl.
CPC ... *G09G 3/3225* (2013.01); *G09G 2300/0413* (2013.01); *G09G 2320/0223* (2013.01)

(58) Field of Classification Search
CPC ..... G09G 3/3225; G09G 2300/0413; G09G 2300/0223
See application file for complete search history.

(56) References Cited

U.S. PATENT DOCUMENTS

| | | | | |
|---|---|---|---|---|
| 6,496,238 | B1 | 12/2002 | Greene et al. | |
| 6,654,449 | B1 | 11/2003 | Greene et al. | |
| 2003/0006947 | A1* | 1/2003 | Moon | G09G 3/22 345/75.2 |
| 2012/0038608 | A1* | 2/2012 | Seo | G09G 3/3233 345/211 |
| 2015/0262554 | A1 | 9/2015 | Park et al. | |
| 2017/0053597 | A1 | 2/2017 | Kim | |

FOREIGN PATENT DOCUMENTS

| | | |
|---|---|---|
| JP | 2009-069768 | 4/2009 |
| KR | 10-2005-0015163 | 2/2005 |
| KR | 10-0599470 | 7/2006 |
| KR | 10-0721944 | 5/2015 |
| KR | 10-2015-0107943 | 9/2015 |
| KR | 10-1589755 | 1/2016 |
| KR | 10-2017-0021432 | 2/2017 |

* cited by examiner

*Primary Examiner* — Wing H Chow
(74) *Attorney, Agent, or Firm* — H.C. Park & Associates, PLC

(57) ABSTRACT

A display apparatus includes a plurality of pixels, and a plurality of scan lines, a plurality of data lines, and a plurality of light emission lines connected to the pixels. Scan signals are applied to the pixels through the scan lines, each of the scan signals has a first level and a second level higher than the first level, an amplitude of each of the scan signals is a difference between the first level and the second level, and the amplitude of a scan signal applied to an (h+1)th scan line is larger than the amplitude of a scan signal applied to an hth scan line.

16 Claims, 8 Drawing Sheets

DISPLAY APPARATUS

CROSS-REFERENCE TO RELATED APPLICATIONS

This application claims priority from and the benefit of Korean Patent Application No. 10-2016-0071262, filed on Jun. 8, 2016, which is hereby incorporated by reference for all purposes as if fully set forth herein.

BACKGROUND

Field

Exemplary embodiments relate to a display apparatus. More particularly, exemplary embodiments relate to a display apparatus with improved display quality and reduced resistance-capacitance (RC) delay.

Discussion of the Background

Various display apparatuses for providing images to users, such as monitors, tablets, smartphones, tablet PCs, etc., are being used. Various display apparatuses such as a liquid crystal display apparatus, an organic light-emitting display apparatus, an electrowetting display apparatus, an electrophoretic display apparatus, etc. have been developed.

In general, display apparatuses include a plurality of pixels which receive voltages and display images in response to gate signals (or scanning signals). Pixels of an organic light-emitting display apparatus among such display apparatuses may further receive light emission control signals to display an image in response to the light emission control signals.

Recently, researchers have studied minimizing a non-display area of a display apparatus to meet consumers' requests for larger displays in smaller housings. To reduce a non-display area of a display apparatus, drivers for generating gate signals, data voltages, and light emission control signals may be arranged at an area adjacent to one side of the display apparatus. However, placing the drivers at one side of the display apparatus requires that the signal wiring must be moved to a different location (e.g., a second side) causing RC delay by requiring the signals to travel over a longer wiring path. In other words, the response time of the display apparatus increases decreasing image quality.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display apparatus with improved display quality and reduced RC delay.

Additional aspects will be set forth in the detailed description which follows, and, in part, will be apparent from the disclosure, or may be learned by practice of the inventive concept.

An exemplary embodiment of the inventive concept provides a display apparatus including a display panel including a plurality of pixels, a plurality of scan lines configured to receive a plurality of scan signals, the scan lines extending in a first direction, a plurality of first dummy lines extending in a second direction crossing the first direction and connected to the scan lines and the pixels, a plurality of data lines configured to receive a plurality of data voltages, the data lines extending in the first direction and connected to the pixels; and a plurality of light emission lines configured to receive a plurality of light emission signals, the light emission lines extending in the first direction and connected to the pixels, wherein each of the scan signals has a first level and a second level higher than the first level, an amplitude of each of the scan signals is a difference between the first level and the second level, and the amplitude of a scan signal applied to an (h+1)th scan line is larger than the amplitude of a scan signal applied to an hth scan line, where h is a natural number.

In an exemplary embodiment, a display apparatus includes a display panel including a plurality of blocks each of which includes a plurality of pixels, a plurality of scan lines configured to receive a plurality of scan signals, the scan lines extending in a first direction, a plurality of first dummy lines extending in a second direction crossing the first direction and connected to the scan lines and the pixels, a plurality of data lines configured to receive a plurality of data voltages, the data lines extending in the first direction and connected to the pixels, a plurality of light emission lines configured to receive a plurality of light emission signals, the light emission lines extending in the first direction, and a plurality of second dummy lines extending in the second direction and connected to the light emission lines and the pixels, wherein the blocks extend in the second direction and are arranged in the first direction, each of the scan signals has a first level and a second level higher than the first level, an amplitude of each of the scan signals is a difference between the first level and the second level, and the amplitudes of scan signals applied to pixels of an (h+1)th block are larger than the amplitudes of scan signals applied to pixels of an hth block, where h is a natural number.

In an exemplary embodiment, a display apparatus includes a display panel including a plurality of pixels; a plurality of scan lines configured to receive a plurality of scan signals, the scan lines extending in a first direction, a plurality of first dummy lines extending in a second direction crossing the first direction and connected to the scan lines and the pixels, a plurality of data lines configured to receive a plurality of data voltages, the data lines extending in the first direction and connected to the pixels, a plurality of light emission lines configured to receive a plurality of light emission signals, the light emission lines extending in the first direction and connected to the pixels, and a plurality of second dummy lines extending in the second direction and connected to the light emission lines and the pixels, wherein each of the scan signals has a first level and a second level higher than the first level, an amplitude of each of the scan signals is a difference between the first level and the second level, and the amplitudes of scan signals applied to gth to last scan lines are larger than the amplitudes of scan signals applied to first to (g−1)th scan lines, where g is a natural number larger than 2.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
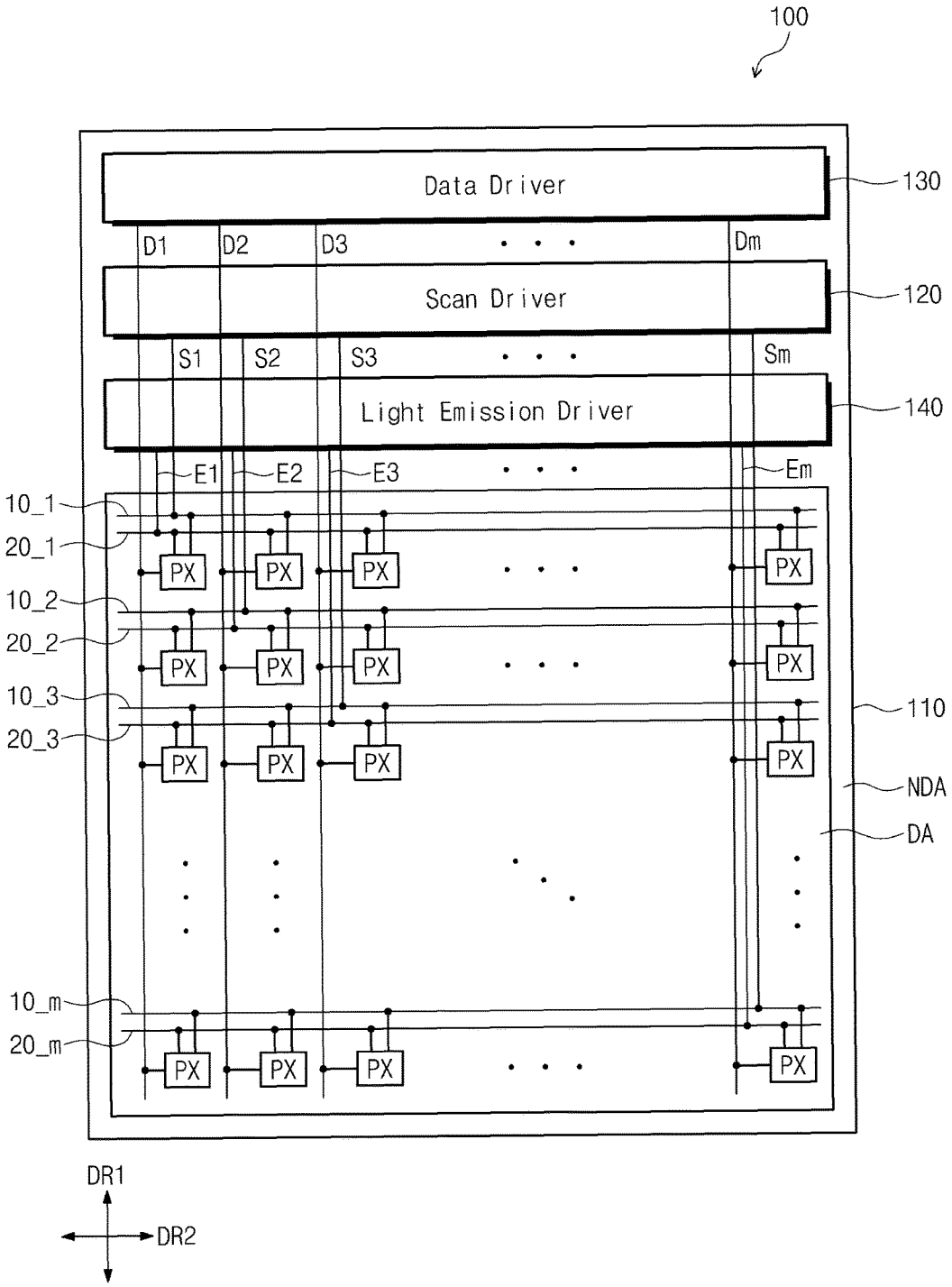
FIG. 1 is a planar view illustrating a display apparatus according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. As such, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a planar view illustrating a display apparatus according to an exemplary embodiment.

Referring to FIG. 1, a display apparatus 100 according to an exemplary embodiment includes a display panel 110, a scan driver 120, a data driver 130, and a light emission driver 140. The scan driver 120, the data driver 130, and the light emission driver 140 may be defined as drivers 120, 130, and 140 for driving the display panel 110.

The drivers 120, 130, and 140 may be arranged in a predetermined area of the display panel 110 adjacent to one side of the display panel 110, and the display panel 110 may be driven by the drivers 120, 130, and 140 to display an image.

The display panel 110 may be an organic light-emitting display panel. However, exemplary embodiments are not limited thereto, and thus the display panel 110 may be a liquid crystal display panel. In this case, a gate driver corresponding to the scan driver 120 and a data driver may be used to drive the display panel 110.

The display panel 110 may have a long side in a first direction DR1 and may have a short side in a second direction DR2 intersecting with the first direction DR1. An area of the display panel 110, in plan view, includes a display area DA and a non-display area NDA disposed around the display area DA. The display area DA may represent an area which displays an image, and the non-display area NDA may represent an area which does not display an image.

The scan driver 120, the data driver 130, and the light emission driver 140 may be located in the non-display area NDA of the display panel 110 adjacent to one side of the display panel 110 in the first direction DR1. For example, the scan driver 120, the data driver 130, and the light emission driver 140 may be arranged in a predetermined area of the non-display area NDA adjacent to an upper side of the display area DA in the first direction DR1.

The data driver 130 may be disposed adjacent to the upper side of the display panel 110 in the first direction DR1, and the light emission driver 140 may be disposed directly adjacent to the upper side of the display area DA in the first direction DR1. The scan driver 120 may be disposed between the data driver 130 and the light emission driver 140. However, exemplary embodiments of the inventive concept are not limited thereto. For example, the scan driver 120 may be directly adjacent to the upper side of the display area DA in the first direction DR1 and the light emission driver 140 may be disposed between the data driver 130 and the scan driver 120.

The display panel 110 includes a plurality of pixels PX, a plurality of scan lines S1 to Sm, a plurality of data lines D1 to Dn, a plurality of light emission lines E1 to Em, a plurality of first dummy lines 10_1 to **10_*m*, and a plurality of second dummy lines 20_1 to 20_*m***, where m an n are natural numbers.

The pixels PX may be arranged in the display area DA of the display panel 110. The pixels PX may be arranged in a matrix form so as to be connected to the scan lines S1 to Sm, the data lines D1 to Dn, and the light emission lines E1 to Em.

The scan lines S1 to Sm extend in the first direction DR1 and are arranged in the second direction DR2 so as to be connected to the scan driver 120. The scan lines S1 to Sm receive scan signals from the scan driver 120.

The data lines D1 to Dn extend in the first direction DR1 and are arranged in the second direction DR2 so as to be connected to the data driver 130. The data lines D1 to Dn receive data voltages from the data driver 130.

The light emission lines E1 to Em extend in the first direction DR1 and are arranged in the second direction DR2 so as to be connected to the light emission driver 140. The light emission lines E1 to Em receive light emission signals from the light emission driver 140.

The first dummy lines 10_1 to **10_*m* extend in the second direction DR2 and are arranged in the first direction DR1 so as to be connected to the scan lines S1 to Sm and the pixels PX. The pixels PX may be electrically connected to the scan lines S1 to Sm through the first dummy lines 10_1 to 10_*m***.

Each of the first dummy lines 10_1 to **10_*m* is connected to a corresponding scan line among the scan lines S1 to Sm. Each of the first dummy lines 10_1 to 10_*m*** is connected to the pixels PX arranged in a corresponding row among the pixels PX arranged in a plurality of rows.

Sequence numbers of the scan lines S1 to Sm increase in a direction from a left side to a right side of the display panel 110 with respect to the second direction DR2, and sequence numbers of the first dummy lines 10_1 to **10_*m* increase in a direction from an upper part to a lower part of the display panel 110** with respect to the first direction DR1.

The scan lines S1 to Sm are one-to-one connected to the first dummy lines 10_1 to **10_*m*** in order. The longer the sequence numbers of the scan lines S1 to Sm, the longer the lengths of the scan lines S1 to Sm. In other words, the length of an (h+1)th scan line is longer than the length of an hth scan line, where h is a natural number.

The second dummy lines 20_1 to **20_*m* extend in the second direction DR2 and are arranged in the first direction DR1 so as to be connected to the light emission lines E1 to Em and the pixels PX. The pixels PX may be electrically connected to the light emission lines E1 to Em through the second dummy lines 20_1 to 20_*m***.

Each of the second dummy lines 20_1 to **20_*m* is connected to a corresponding light emission line among the light emission lines E1 to Em. Each of the second dummy lines 20_1 to 20_*m*** is connected to the pixels PX arranged in a corresponding row among the pixels PX arranged in a plurality of rows.

Sequence numbers of the light emission lines E1 to Em increase in the direction from the left side to the right side of the display panel 110 with respect to the second direction DR2, and sequence numbers of the second dummy lines 20_1 to w**0_*m* increase in the direction from the upper part to the lower part of the display panel 110** with respect to the first direction DR1.

The light emission lines E1 to Em are one-to-one connected to the second dummy lines 20_1 to **20_*m*** in order. The longer the sequence numbers of the light emission lines E1 to Em, the longer the lengths of the light emission lines S1 to Sm. In other words, the length of an (h+1)th light emission line is longer than the length of an hth light emission line.

The scan driver 120 generates a plurality of scan signals, and the scan signals are applied to the pixels PX through the scan lines S1 to Sm and the first dummy lines 10_1 to **10_*m* connected to each other. The scan signals may be sequentially applied to the pixels PX. The scan driver 120 may be manufactured as a type of an integrated circuit chip so as to be disposed in the display panel 110**.

The data driver 130 generates a plurality of data voltages, and the data voltages are applied to the pixels PX through the data lines D1 to Dn. The data driver 130 may be manufactured as a type of an integrated circuit chip so as to be disposed in the display panel 110.

The light emission driver 140 generates a plurality of light emission signals, and the light emission signals are applied to the pixels PX through the light emission lines E1 to Em and the second dummy lines 20_1 to **20_*m* connected to each other. The light emission driver 140 may be manufactured as a type of an integrated circuit chip so as to be disposed in the display panel 110**.

Although not illustrated, a timing controller for controlling operation of the scan driver 120, the data driver 130, and the light emission driver 140 is included in the display apparatus 100. The timing controller generates a scan control signal, a data control signal, and a light emission control signal in response to control signals received from the outside. Furthermore, the timing controller receives image signals from the outside, and converts a data format of the image signals so that the data format is compatible with a specification of an interface with the data driver 130.

The scan driver 120 generates scan signals in response to the scan control signal, and the light emission driver 140 generates light emission signals in response to the light emission control signal. The data driver 130 receives the data-format-converted image signals, and generates data voltages corresponding to the image signals in response to the data control signal.

The pixels PX receives the data voltages through the data lines D1 to Dn in response to the scan signals received through the scan lines S1 to Sm, and charges the data voltages. The pixels PX may display an image by generating light of luminance corresponding to the data voltages in response to the light emission signals received through the light emission lines E1 to Em. Light emission time of the pixels PX may be controlled by the light emission signals.

As described above, the longer the sequence numbers of the scan lines S1 to Sm, the longer the lengths of the scan lines S1 to Sm. As the length of the scan lines S1 to Sm increase, an RC delay may increase. As the RC delay increases, the scan signals may be distorted, and thus a charging time of the data voltages may not be sufficient.

In an exemplary embodiment, as the sequence numbers of the scan lines S1 to Sm increase, amplitudes of the scan signals applied to the scan lines S1 to Sm may gradually increase. Each scan signal has a first level and a second level higher than the first level, and the amplitude of each scan signal may be defined as a difference between the first level and the second level. Since the amplitudes of the scan signals gradually increase, the charging time of the data voltages may be sufficient. This configuration is described in detail below.

Figure 2:
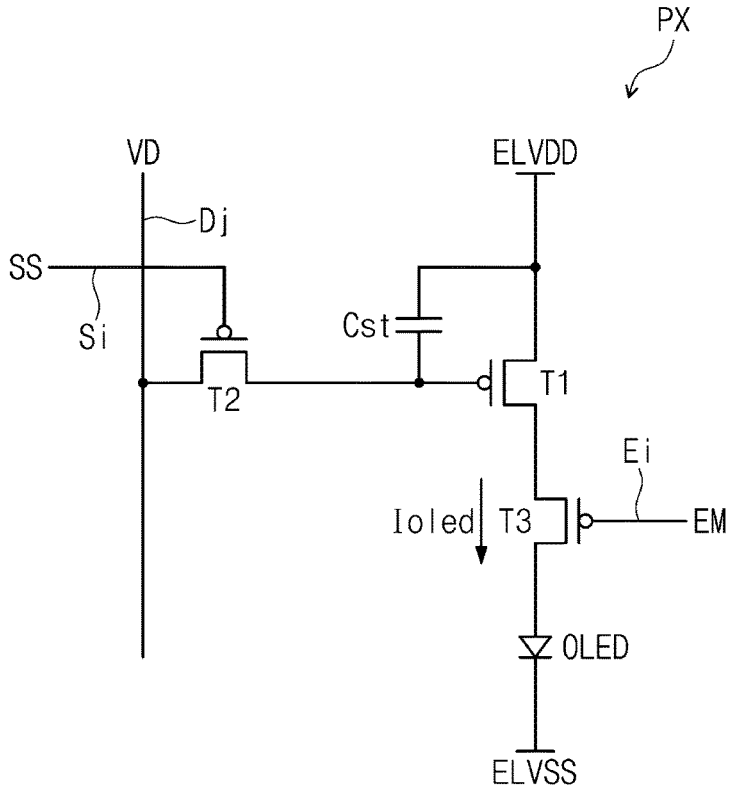
FIG. 2 is an equivalent circuit diagram of one of the pixels arranged in the display panel illustrated in FIG. 1.
Figure 3:
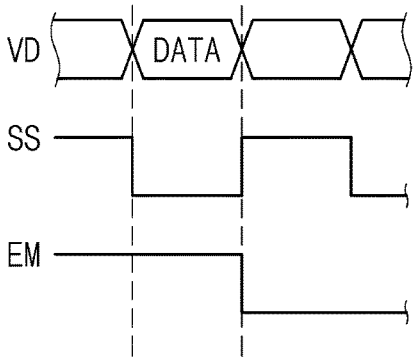
FIG. 3 is a timing diagram of the scan signal, the data voltage, and the light emission signal illustrated in FIG. 2.

FIG. 2 is an equivalent circuit diagram of one of the pixels arranged in the display panel illustrated in FIG. 1. FIG. 3 is a timing diagram of the scan signal, the data voltage, and the light emission signal illustrated in FIG. 2.

Although FIG. 2 illustrates a single pixel PX, the other pixels PX arranged in the display panel 110 have the same configuration as the pixel of FIG. 2. For convenience, FIG. 3 does not illustrate a signal delay caused by the RC delay.

Referring to FIGS. 2 and 3, the pixel PX is connected to a corresponding scan line Si among the scan lines S1 to Sm, a corresponding data line Dj among the data lines D1 to Dn, and a corresponding light emission line Ei among the light emission lines E1 to Em, where i is a natural number equal to or smaller than m, and j is a natural number equal to or smaller than n.

The pixel includes a light emission element OLED, a driving transistor T1, a capacitive element Cst, a switching transistor T2, and a light emission control transistor T3. The light emission element OLED may be defined as an organic light-emitting diode.

A source terminal of the driving transistor T1 receives a first voltage ELVDD, and a drain terminal of the driving transistor T1 is connected to a source terminal of the light emission control transistor T3. A gate terminal of the driving transistor T1 is connected to a drain terminal of the switching transistor T2.

A gate terminal of the switching transistor T2 is connected to the scan line Si, and a source terminal of the switching transistor T2 is connected to the data line Dj. A first electrode of the capacitive element Cst is connected to the source terminal of the driving transistor T1, and a second electrode of the capacitive element Cst is connected to the gate terminal of the driving transistor T1.

A gate terminal of the light emission control transistor T3 is connected to the light emission line Ei, and a drain terminal of the light emission control transistor T3 is connected to an anode electrode of the light emission element OLED. A cathode of the light emission element receives a second voltage ELVSS. The second voltage ELVSS may have a lower level than that of the first voltage ELVDD.

The switching transistor T2 is turned on in response to a scan signal SS received through the scan line Si. The turned-on switching transistor T2 provides, to the gate terminal of the driving transistor T1, a data voltage VD received through the data line Dj. The capacitive element Cst charges the data voltage VD applied to the gate terminal of the driving transistor T1, and maintains this state even after the switching transistor T2 is turned off.

The light emission control transistor T3 is turned on in response to a light emission signal EM received through the light emission line Ei. The turned-on light emission control transistor T3 provides, to the light emission element OLED, a current Ioled which flows through the driving transistor T1. The pixel PX may emit light during an application time of the light emission signal EM. The light emission element OLED emits light with different intensities according to an amount of the current Ioled.

FIG. 3 exemplarily illustrates the scan signal SS and the light emission signal EM applied to one pixel PX, but in practice, the scan signals may be applied to all the pixels PX to charge the pixels PX with data voltages, and then the pixels PX may simultaneously emit light in response to the light emission signals. Although FIG. 2 illustrates the transistors T1 to T3 of the pixel PX as p-channel metal oxide (PMOS) transistors, but exemplary embodiments are not limited thereto. For example, the transistors T1 to T3 of the pixel PX may be n-channel metal oxide (NMOS) transistors.

Figure 4:
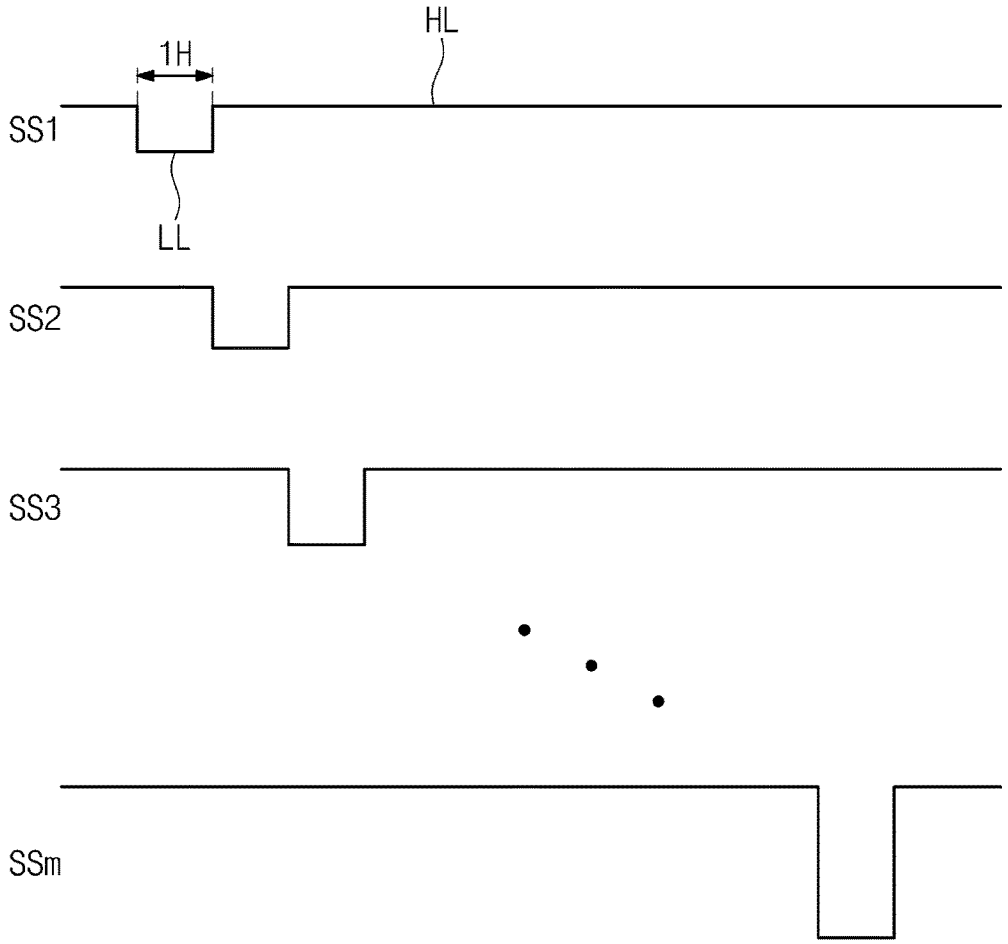
FIG. 4 is a timing diagram of the scan signals applied to the pixels illustrated in FIG. 1.
Figure 5:
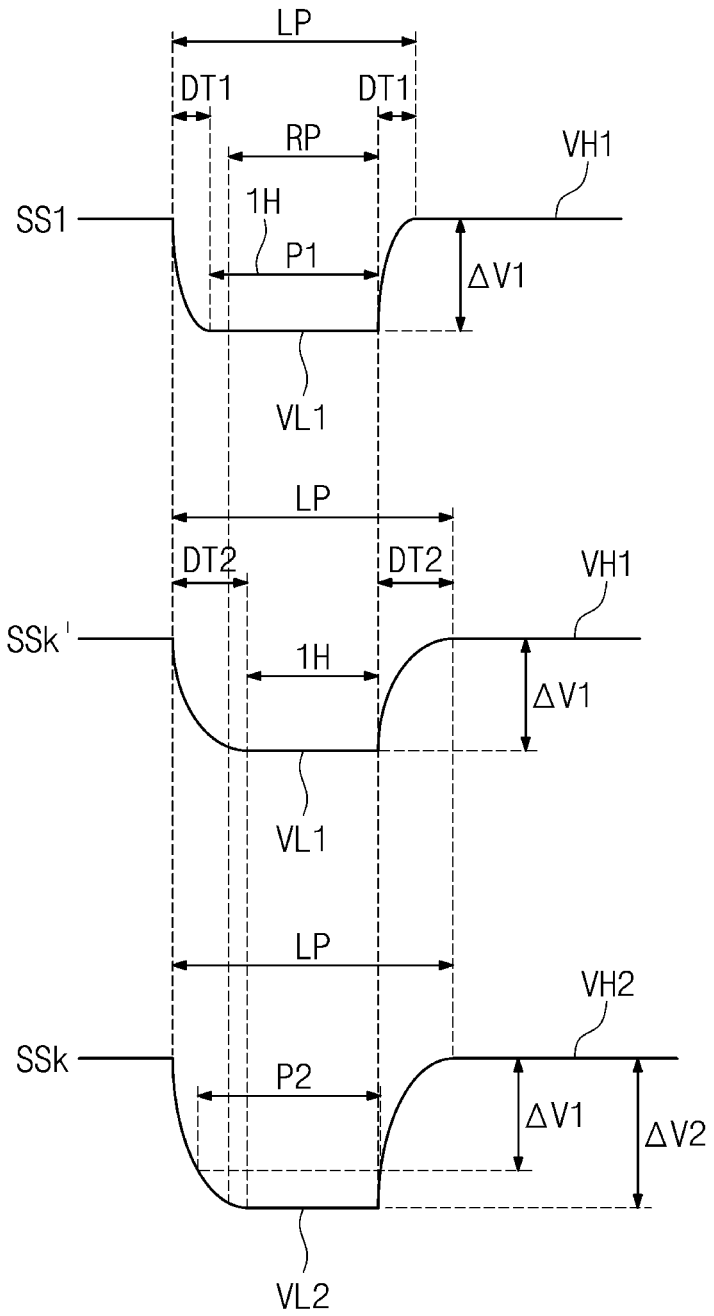
FIG. 5 is a diagram illustrating scan signals applied to an hth scan line and an (h+1)th scan line.

FIG. 4 is a timing diagram of the scan signals applied to the pixels illustrated in FIG. 1. FIG. 5 is a diagram exemplarily illustrating scan signals applied to an hth scan line and an (h+1)th scan line.

For convenience, FIG. 4 does not illustrate a signal delay caused by the RC delay, but FIG. 5 illustrates the signal delay caused by the RC delay.

Referring to FIG. 4, scan signals SS1 to SSm are sequentially applied to the scan lines S1 to Sm. Each of the scan signals SS1 to SSm may have a first level which is a low level LL during an activation period 1H, and may have a second level which is a high level HL during a deactivation period other than the activation period 1H. The switching transistors T2 of the pixels PX may be turned on in the activation periods 1H of the scan signals SS1 to SSm.

The amplitude of each of the scan signals SS1 to SSm may be defined as a difference between the first level and the second level of each of the scan signals SS1 to SSm. As the sequence numbers of the scan lines S1 to Sm increase, the amplitudes of the scan signals SS1 to SSm applied to the scan lines S1 to Sm may gradually increase. For example, the amplitude of the (h+1)th scan signal applied to the (h+1)th scan line is larger than the amplitude of the hth scan signal applied to the hth scan line.

Referring to FIG. 5, the first scan signal SS1 applied to the first scan line S1, among the scan signals SS1 to SSm, includes a first low voltage VL1 defined as the first level of the first scan signal SS1 and a first high voltage VH1 defined as the second level of the first scan signal SS1. A difference between the first low voltage VL1 and the first high voltage VH1 may be defined as a first voltage ΔV1, and the first voltage ΔV1 may be defined as the amplitude of the first scan signal SS1.

During a first distortion period DT in which the first scan signal SS1 is distorted (e.g., delayed) due to the RC delay, the first scan signal SS1 does not have the first voltage ΔV1. In the activation period 1H of the first scan signal SS1 in which the low level of the first scan signal SS1 is maintained, the difference between the first low voltage VL1 and the first high voltage VH1 may be the first voltage ΔV1.

Regarding the scan signals SS1 to SSm, a period of each scan signal in which each scan signal has the low level lower than the high level is defined as a low period LP. The activation period 1H of each of the scan signals SS1 to SSm represent a period in which the low level is maintained. The switching transistors T2 may be driven during periods of the scan signals SS1 to SSm in which the scan signals SS1 to SSm have the first voltage ΔV1 during the low periods LP.

In order for the pixels PX to be sufficiently charged with the data voltages, the period of each of the scan signals SS1 to SSm in which each of the scan signals SS1 to SSm has the first voltage ΔV1 is required to be maintained for a predetermined reference period RP. In other words, when a period of each of the scan signals SS1 to SSm in which each of the scan signal SS1 to SSm has the first voltage ΔV1 is equal to or longer than the reference period RP during the low period LP of each of the scan signals SS1 to SSm, the data voltages may be charged to the pixels PX normally.

The period of the first scan signal SS1 in which the first scan signal SS1 has the first voltage ΔV1 during the low period LP of the first scan signal SS1 is defined as a first period P1, and the first period P1 is longer than the reference period RP. Therefore, the pixels PX driven by the first scan signal SS1 may charge the data voltages normally.

The scan signals SS1 to SSm output from the scan driver 120 may be distorted due to the RC delay of the scan lines S1 to Sm. A k'th scan signal SSk' having the same amplitude as the first scan signal SS1 may be applied to a kth scan line, and the k'th scan signal SSk' may be distorted due to the RC delay, where k' and k are natural numbers equal to or larger than 2.

A distortion period DT2 of the k'th scan signal SSk' is longer than a distortion period DT1 of the first scan signal SS1. In this case, the activation period 1H of the k'th scan signal SSk' in which the k'th scan signal SSk' has the first voltage ΔV1 may be shorter than the reference period RP. Therefore, the pixels PX driven by the k'th scan signal SSk' may be unable to charge the data voltages normally. When the pixels PX are unable to charge the data voltages normally, an image may not be displayed normally, and thus display quality may be deteriorated.

In an exemplary embodiment, as the sequence numbers of the scan lines S1 to Sm increase, the amplitudes of the scan signals SS1 to SSm applied to the scan lines S1 to Sm may gradually increase. For example, a kth scan signal SSk applied to a kth scan line includes a second low voltage VL2 defined as the first level of a kth scan signal SSk and a second high voltage VH2 defined as the second level of the kth scan signal SSk. A difference between the second low voltage VL2 and the second high voltage VH2 may be defined as a second voltage ΔV2, and the second voltage ΔV2 may be defined as the amplitude of the kth scan signal SSk.

The second low voltage VL2 may have a lower level than that of the first low voltage VL1, and the second high voltage VH2 may have a higher level than that of the first high voltage VH1. Therefore, the amplitude of the kth scan signal SSk is larger than the amplitude of the first scan signal SS1, and the second voltage ΔV2 has a larger value than that of the first voltage ΔV1.

The activation period 1H of the kth scan signal SSk in which the kth scan signal SSk maintains the low level may be shorter than the reference period RP. However, the period of the kth scan signal SSk in which the kth scan signal SSk has the first voltage ΔV1 during the low period LP of the kth scan signal SSk is defined as a second period P2, and the second period P2 is longer than the reference period RP.

Since the second period P2 of the kth scan signal SSk in which the kth scan signal SSk has the first voltage ΔV1 is longer than the reference period RP, the pixels PX driven by the kth scan signal SSk may charge the data voltages normally. That is, in an exemplary embodiment, the amplitude of each of the scan signals SS1 to SSm may be set so that the period of each of the scan signals SS1 to SSm in which each of the scan signals SS1 to SSm has the first voltage ΔV1 is longer than the reference period RP during the low period of each of the scan signals SS1 to SSm.

The kth scan signal SSk has been exemplarily described as including the second low voltage VL2 which has a lower level than that of the first low voltage VL1 and the second high voltage VH2 which has a higher level than that of the first high voltage VH1. However, exemplary embodiments are not limited thereto. The high level and the low level of the kth scan signal SSk may be variously determined, provided that the amplitude of the kth scan signal SSk is larger than that of the first scan signal SS1.

For example, the kth scan signal SSk may include the first low voltage VL1 and a third high voltage higher than the first high voltage VH1, wherein a difference between the first low voltage VL1 and the third voltage may be larger than the first voltage ΔV1. Alternatively, the kth scan signal SSk may include a third low voltage having a lower level than that of the first low voltage VL1 and the first high voltage VH1, wherein a difference between the third low voltage and the first high voltage VH1 may be larger than the first voltage ΔV1.

Even in this case, the amplitude of the kth scan signal SSk may be set so that the period of the kth scan signal SSk in which the kth scan signal SSk has the first voltage ΔV1 is longer than the reference period RP during the low period LP of the kth scan signal SSk.

As a result, the display apparatus 100 according to an exemplary embodiment may charge the pixels PX with the data voltages normally according to the scan signals SS1 to SSm, so that the display quality may be improved.

Figure 6:
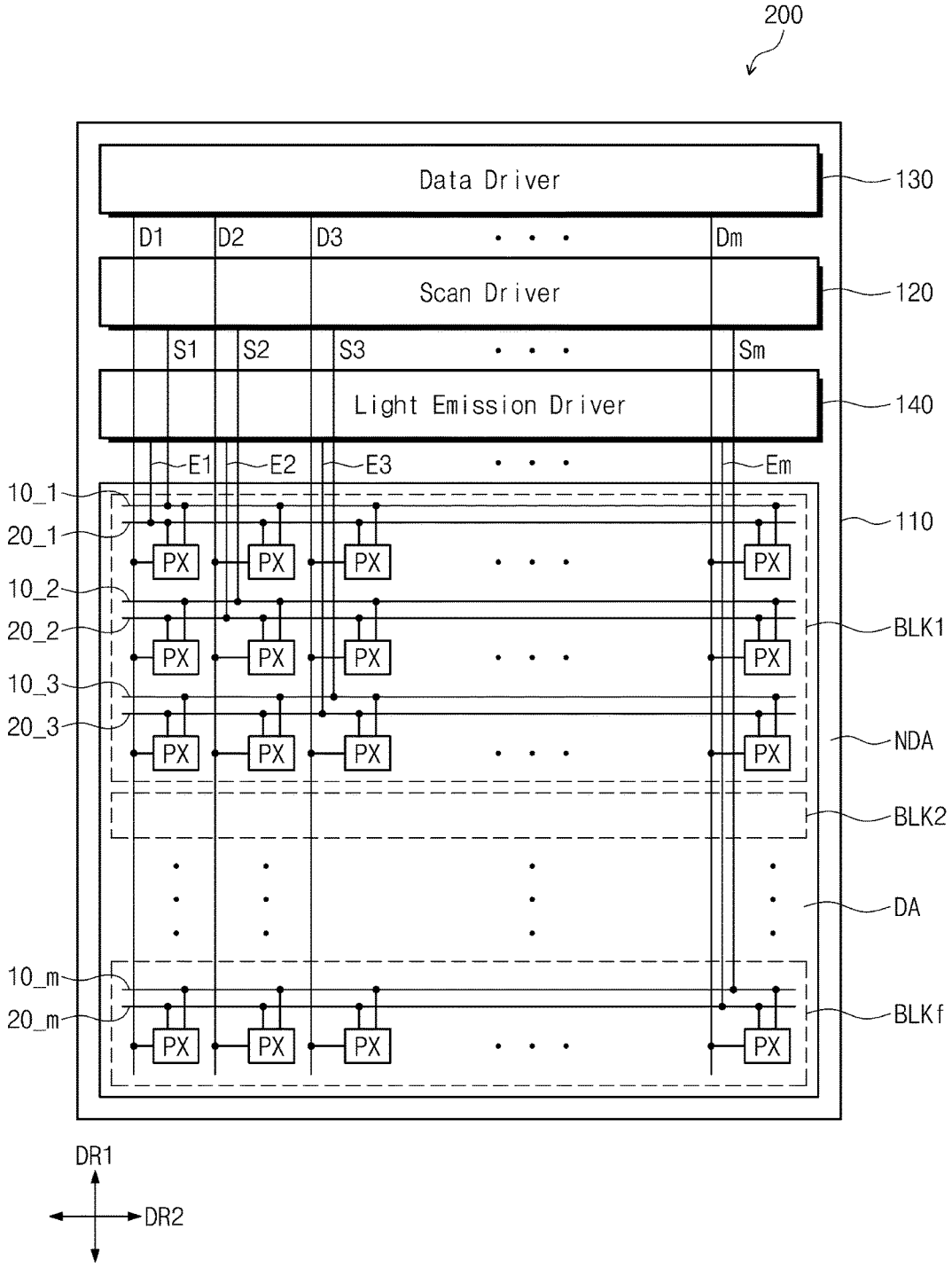
FIG. 6 is a planar view illustrating a display apparatus according to an exemplary embodiment.
Figure 7:
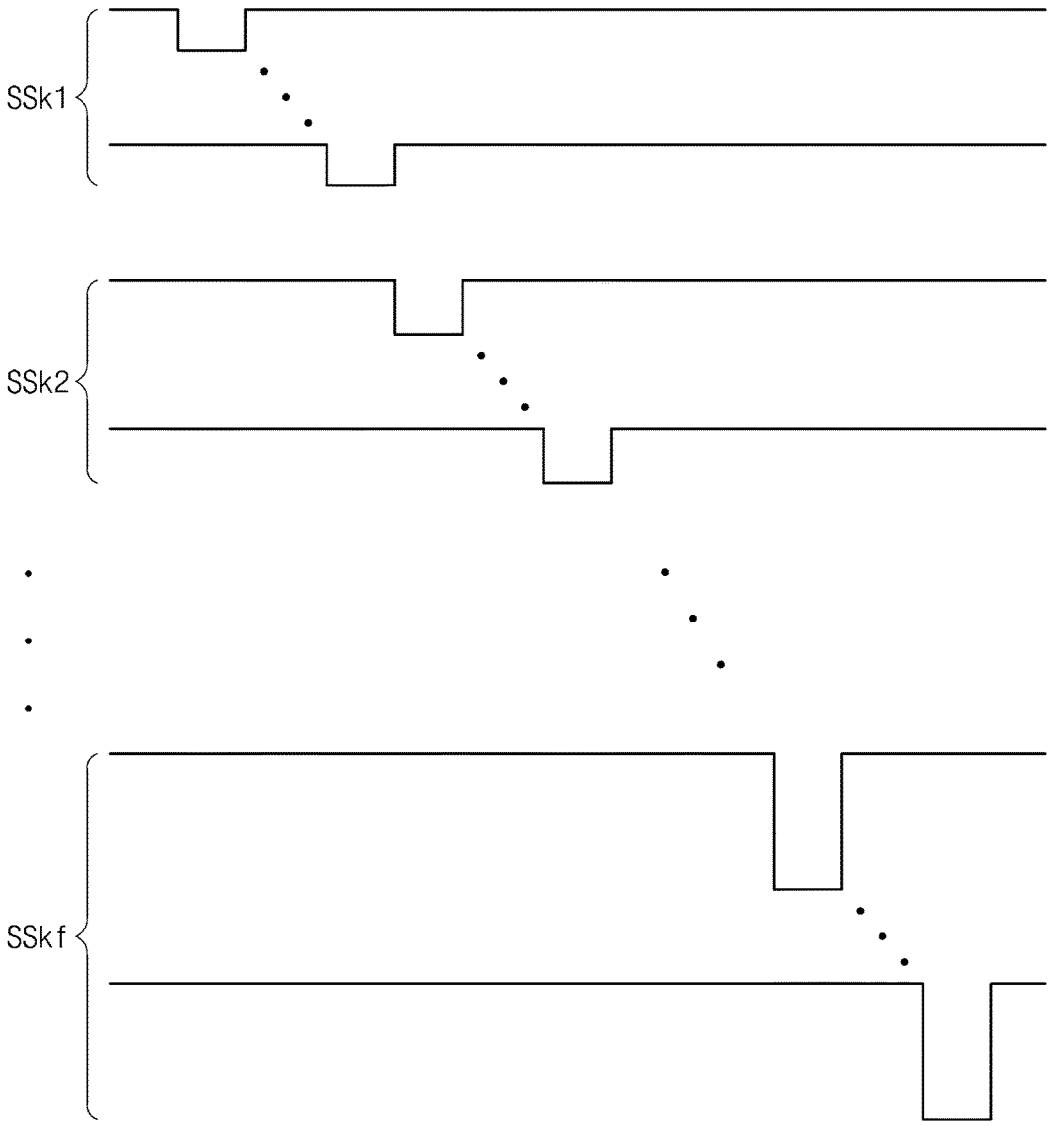
FIG. 7 is a timing diagram of the scan signals applied to the pixels illustrated in FIG. 6.

FIG. 6 is a planar view illustrating a display apparatus according to an exemplary embodiment. FIG. 7 is a timing diagram of the scan signals applied to the pixels illustrated in FIG. 6.

The configuration of the display apparatus 200 illustrated in FIG. 6 is substantially the same as the configuration of the display apparatus 100 illustrated in FIG. 1, except for an application timing of scan signals SSK1 to SSKf. Therefore, in FIG. 6, the elements of the display apparatus 200 which are the same as those of the display apparatus 100 are referred to by the same reference numerals, and a configuration different from that of the display apparatus 100 is described below.

Referring to FIGS. 6 and 7, the display area DA of the display panel 110 includes a plurality of blocks BLK1 to BLKf, wherein the blocks BLK1 to BLKf are arranged in the first direction DR1 and extend in the second direction DR2, where f is a natural number. Each of the blocks BLK1 to BLKf includes a plurality of pixels PX arranged in a matrix form. The sequence numbers of the blocks BLK1 to BLKf increase in the direction from the upper part to the lower part of the display panel 110 with respect to the first direction DR1.

The connection relationships among the drivers 120, 130, and 140, the pixels PX, the scan lines S1 to Sm, the data lines D1 to Dn, the light emission lines E1 to Em, the first dummy lines 10_1 to 10_*m*, and the second dummy lines 20_1 to 20_*m* of the display apparatus 200 are the same as the connection relationships among the drivers 120, 130, and 140, the pixels PX, the scan lines S1 to Sm, the data lines D1 to Dn, the light emission lines E1 to Em, the first dummy lines 10_1 to 10_*m*, and the second dummy lines 20_1 to 20_*m* of the display apparatus 100, and are thus not described below.

The failure in charging data voltages, which is caused by the distortion of scan signals due to the RC delay, may occur after a certain number of scan lines. Therefore, the amplitudes of the scan signals SSK1 to SSKf may be gradually increased on a per block basis, so that the pixels PX may be charged with the data voltages normally.

In an exemplary embodiment, the scan signals applied to the pixels PX of the same block have the same amplitude, and as the sequence numbers of the blocks BLK1 to BLKf increase, the amplitudes of the scan signals SSK1 to SSKf may gradually increase. In other words, the amplitudes of the scan signals applied to the pixels PX of an (h+1)th block are larger than the amplitudes of the scan signals applied to the pixels PX of an hth block.

For example, the first scan signals SSK1 having the same amplitude are applied to the pixels of the first block BLK1 among the blocks BLK1 to BLKf. The second scan signals SSK2 having the same amplitude are applied to the pixels PX of the second block BLK2, and the amplitudes of the second scan signals SSK2 are larger than the amplitudes of the first scan signals SSK1.

Furthermore, the amplitude of each of the scan signals applied to the pixels of the same block is set so that the period of each scan signal in which each scan signal has the first voltage ΔV1 is longer than the reference period RP during the low period LP of each scan signal. Therefore, the pixels PX driven by the scan signals SSK1 to SSKf may charge the data voltages normally.

As a result, the display apparatus 200 according to an exemplary embodiment may charge the pixels PX with the data voltages normally according to the scan signals SSK1 to SSKf, so that the display quality may be improved.

Figure 8:
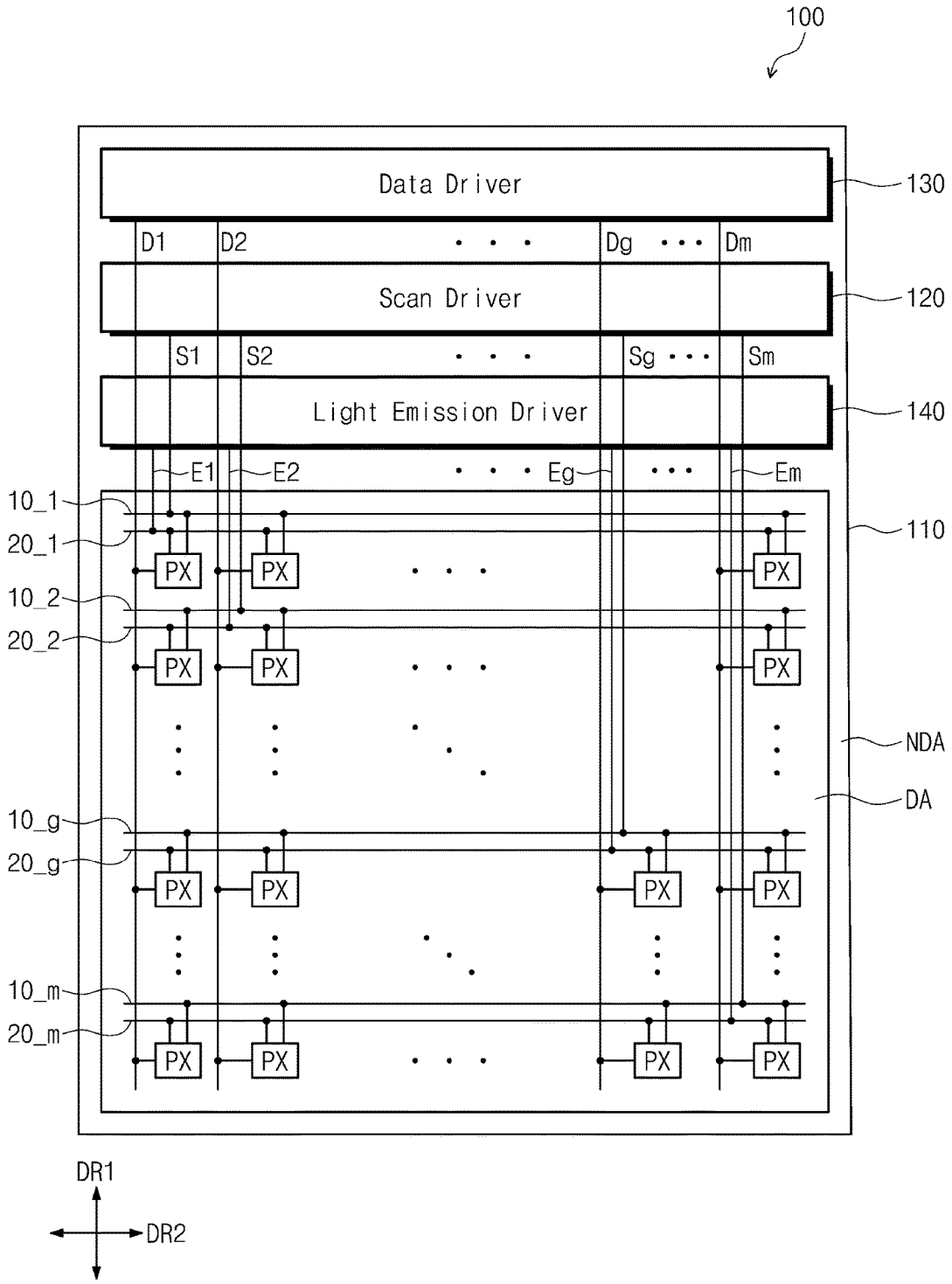
FIG. 8 is a planar view illustrating a display apparatus according to an exemplary embodiment.
Figure 9:
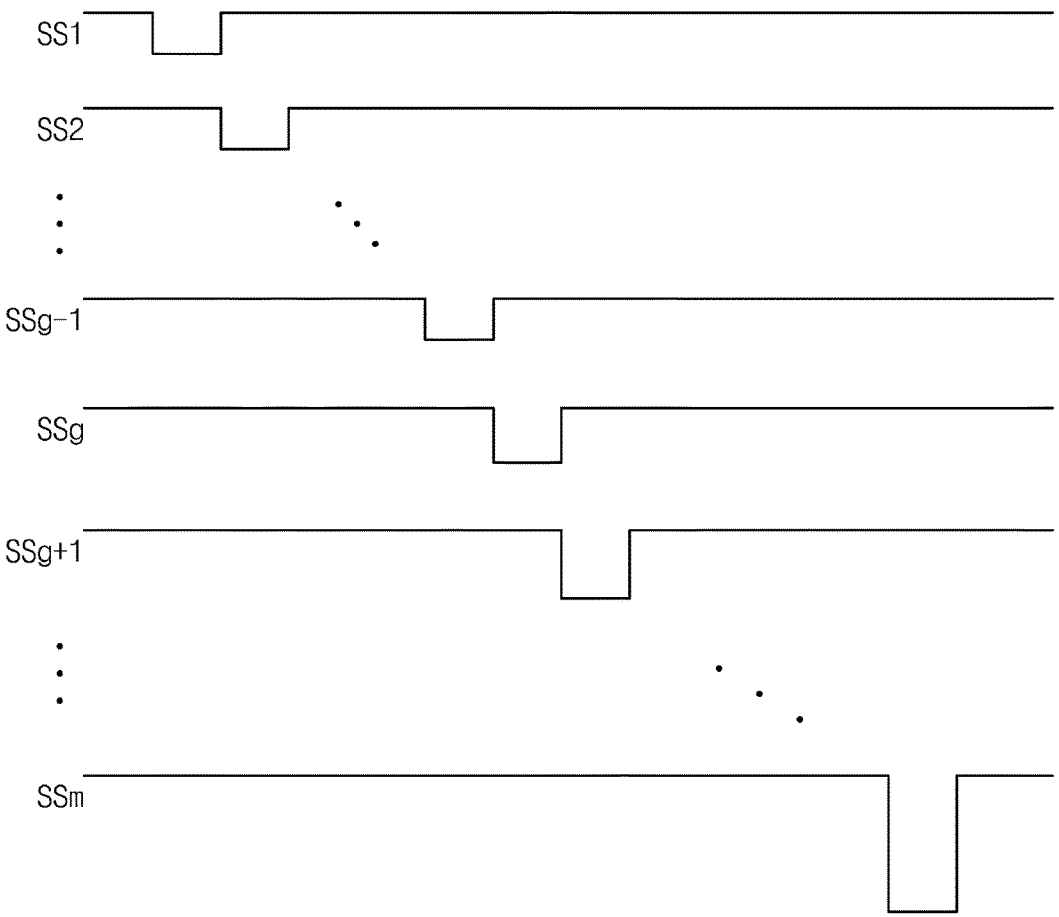
FIG. 9 is a timing diagram of the scan signals applied to the pixels illustrated in FIG. 8.

FIG. 8 is a planar view illustrating a display apparatus according to an exemplary embodiment. FIG. 9 is a timing diagram of the scan signals applied to the pixels illustrated in FIG. 8.

The configuration of the display apparatus 300 illustrated in FIG. 8 is substantially the same as the configuration of the display apparatus 100 illustrated in FIG. 1, except for an application timing of scan signals SS1 to SSm. Therefore, in FIG. 8, the elements of the display apparatus 300 which are the same as those of the display apparatus 100 are referred to by the same reference numerals, and a configuration different from that of the display apparatus 100 is described below.

Referring to FIGS. 8 and 9, the connection relationships among the drivers 120, 130, and 140, the pixels PX, the scan lines S1 to Sm, the data lines D1 to Dn, the light emission lines E1 to Em, the first dummy lines 10_1 to 10_*m*, and the second dummy lines 20_1 to 20_*m* of the display apparatus 300 are the same as the connection relationships among the drivers 120, 130, and 140, the pixels PX, the scan lines S1 to Sm, the data lines D1 to Dn, the light emission lines E1 to Em, the first dummy lines 10_1 to 10_*m*, and the second dummy lines 20_1 to 20_*m* of the display apparatus 100, and are thus not described below.

Even if the scan signals SS1 to SSm are distorted due to the RC delay, the failure in charging data voltages may not occur on a first scan line to (g−1)th scan line, but may occur on a gth scan line Sg, where g is a natural number larger than 2.

In an exemplary embodiment, scan signals SS1 to SSg−1 applied to the first to (g−1)th scan lines may have the same amplitude. The amplitudes of the scan signals SSg to SSm applied to the gth to last scan lines Sg to Sm are larger than the amplitudes of the scan signals SS1 to SSg−1 applied to the first to (g−1)th scan lines. As the sequence numbers of the gth to last scan lines Sg to Sm increase, the amplitudes of the scan signals SSg to SS applied to the gth to last scan lines Sg to Sm may gradually increase.

The amplitudes of the scan signals SS1 to SSg−1 applied to the first to (g−1)th scan lines may be substantially the same as the amplitude of the first scan signal SS1 illustrated in FIG. 5. The amplitude of each of the scan signals SSg to SSm applied to the gth to last scan lines Sg to Sm is set so that the period of each of the scan signals SSg to SSm in which each of the scan signals SSg to SSm has the first voltage ΔV1 is longer than the reference period RP during the low period LP of each of the scan signals SSg to SSm. Therefore, the pixels PX may be charged with the data voltages normally.

As a result, the display apparatus 300 may charge the pixels PX with the data voltages normally according to the scan signals SS1 to SSm, so that the display quality may be improved.

A display apparatus according to an exemplary embodiment of the may improve the display quality by charging pixels with data voltages normally according to scan signals.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus, comprising:

a display panel comprising a plurality of pixels;

a plurality of scan lines configured to receive a plurality of scan signals, the scan lines extending in a first direction;

a plurality of first dummy lines extending in a second direction crossing the first direction and connected to the scan lines and the pixels;

a plurality of data lines configured to receive a plurality of data voltages, the data lines extending in the first direction and connected to the pixels; and a plurality of light emission lines configured to receive a plurality of light emission signals, the light emission lines extending in the first direction and connected to the pixels, wherein:

each of the scan signals has a first level and a second level higher than the first level, an amplitude of each of the scan signals is a difference between the first level and the second level, and the amplitude of a scan signal applied to an (h+1)th scan line is larger than the amplitude of a scan signal applied to an hth scan line, where h is a natural number;

a first scan signal applied to a first scan line among the scan lines comprises:

a first low voltage having the first level of the first scan signal; and a first high voltage having the second level of the first scan signal; and a period of each of the scan signals in which each of the scan signals has a lower level than the second level is a low period, a difference between the first low voltage and the first high voltage is a first voltage, and the amplitude of each of the scan signals is set so that a period of each of the scan signals in which each of the scan signals has the first voltage is longer than a predetermined reference period during the low period of each of the scan signals.

2. The display apparatus of claim 1, wherein the scan lines are one-to-one connected to the first dummy lines in order, and a length of the (h+1)th scan line is longer than a length of the hth scan line.

3. The display apparatus of claim 1, further comprising a plurality of second dummy lines extending in the second direction and connected to the light emission lines and the pixels.

4. The display apparatus of claim 3, wherein the light emission lines are one-to-one connected to the second dummy lines in order, and a length of an (h+1)th light emission line is longer than a length of an hth light emission line.

5. The display apparatus of claim 1, wherein a kth scan signal applied to a kth scan line among the scan lines comprises:

a second low voltage having a lower level than that of the first low voltage; and a second high voltage having a higher level than that of the first high voltage, where k is a natural number equal to or larger than 2.

6. The display apparatus of claim 1, wherein a kth scan signal applied to a kth scan line among the scan lines comprises:

the first low voltage; and a third high voltage having a higher level than that of the first high voltage, where k is a natural number equal to or larger than 2.

7. The display apparatus of claim 1, wherein a kth scan signal applied to a kth scan line among the scan lines comprises:

a third low voltage having a lower level than that of the first low voltage; and the first high voltage, where k is a natural number equal to or larger than 2.

8. The display apparatus of claim 1, further comprising:

a scan driver configured to generate the scan signals and apply the scan signals to the scan lines;

a data driver configured to generate the data voltages and apply the data voltages to the data lines; and a light emission driver configured to generate the light emission signals and apply the light emission signals to the light emission lines.

9. The display apparatus of claim 8, wherein the scan driver, the data driver, and the light emission driver are disposed in a predetermined area of the display panel adjacent to one side of the display panel in the first direction.

10. A display apparatus, comprising:

a display panel comprising a plurality of blocks each of which comprises a plurality of pixels;

a plurality of scan lines configured to receive a plurality of scan signals, the scan lines extending in a first direction;

a plurality of first dummy lines extending in a second direction crossing the first direction and connected to the scan lines and the pixels;

a plurality of data lines configured to receive a plurality of data voltages, the data lines extending in the first direction and connected to the pixels;

a plurality of light emission lines configured to receive a plurality of light emission signals, the light emission lines extending in the first direction; and a plurality of second dummy lines extending in the second direction and connected to the light emission lines and the pixels, wherein:

the blocks extend in the second direction and are arranged in the first direction, each of the scan signals has a first level and a second level higher than the first level, an amplitude of each of the scan signals is a difference between the first level and the second level, and the amplitudes of scan signals applied to pixels of an (h+1)th block are larger than the amplitudes of scan signals applied to pixels of an hth block, where h is a natural number;

a first scan signal applied to a first scan line among the scan lines comprises:

a first low voltage having the first level of the first scan signal; and a first high voltage having the second level of the first scan signal; and a period of each of the scan signals in which each of the scan signals has a lower level than the second level is a low period, a difference between the first low voltage and the first high voltage is a first voltage, and the amplitude of each of the scan signals is set so that a period of each of the scan signals in which each of the scan signals has the first voltage is longer than a predetermined reference period during the low period of each of the scan signals.

11. The display apparatus of claim 10, wherein scan signals applied to pixels of the same block have the same amplitude.

12. The display apparatus of claim 10, further comprising:

a scan driver configured to generate the scan signals and apply the scan signals to the scan lines;

a data driver configured to generate the data voltages and apply the data voltages to the data lines; and a light emission driver configured to generate the light emission signals and apply the light emission signals to the light emission lines, wherein the scan driver, the data driver, and the light emission driver are disposed in a predetermined area of the display panel adjacent to one side of the display panel in the first direction.

13. A display apparatus, comprising:

a display panel comprising a plurality of pixels;

a plurality of scan lines configured to receive a plurality of scan signals, the scan lines extending in a first direction;

a plurality of first dummy lines extending in a second direction crossing the first direction and connected to the scan lines and the pixels;

a plurality of data lines configured to receive a plurality of data voltages, the data lines extending in the first direction and connected to the pixels;

a plurality of light emission lines configured to receive a plurality of light emission signals, the light emission lines extending in the first direction and connected to the pixels; and a plurality of second dummy lines extending in the second direction and connected to the light emission lines and the pixels, wherein each of the scan signals has a first level and a second level higher than the first level, an amplitude of each of the scan signals is a difference between the first level and the second level, and the amplitudes of scan signals applied to gth to last scan lines are larger than the amplitudes of scan signals applied to first to (g−1)th scan lines, where g is a natural number larger than 2.

14. The display apparatus of claim 13, wherein, as sequence numbers of the gth to last scan lines increase, the amplitudes of the scan signals applied to the gth to last scan lines gradually increase.

15. The display apparatus of claim 13, wherein the scan signals applied to the first to (g−1)th scan lines have the same amplitude.

16. The display apparatus of claim 13, further comprising:

a scan driver configured to generate the scan signals and apply the scan signals to the scan lines;

a data driver configured to generate the data voltages and apply the data voltages to the data lines; and a light emission driver configured to generate the light emission signals and apply the light emission signals to the light emission lines, wherein the scan driver, the data driver, and the light emission driver are disposed in a predetermined area of the display panel adjacent to one side of the display panel in the first direction.

* * * * *